United States Patent [19]

French et al.

[11] 4,144,929

[45] Mar. 20, 1979

[54] REGENERATOR DISC DRIVE

[75] Inventors: James M. French, Plainfield; Samuel R. Thrasher, Indianapolis, both of Ind.

[73] Assignee: General Motors Corporation, Detroit, Mich.

[21] Appl. No.: 851,171

[22] Filed: Nov. 14, 1977

[51] Int. Cl.[2] ..... F28D 19/00

[52] U.S. Cl. ..... 165/8; 64/27 R; 64/27 CS; 74/443; 267/136; 267/181

[58] Field of Search ..... 165/8; 267/136, 147, 267/181; 64/27 CS, 27 R; 74/443

[56] References Cited

U.S. PATENT DOCUMENTS

| | | | |
|---|---|---|---|
| 3,257,860 | 6/1966 | Runde et al. | 74/443 X |
| 3,296,829 | 1/1967 | Williams | 165/8 X |
| 3,476,173 | 11/1969 | Bracken, Jr. et al. | 165/8 X |
| 3,612,163 | 10/1971 | Powell | 165/8 |
| 3,834,881 | 9/1974 | Niebylski | 267/181 X |
| 3,850,228 | 11/1974 | Barnard | 165/8 |
| 3,913,662 | 10/1975 | Davis | 165/8 |

*Primary Examiner*—Albert W. Davis, Jr.
*Attorney, Agent, or Firm*—J. C. Evans

[57] ABSTRACT

A regenerator assembly for a gas turbine engine includes a center driven, rotatable disc type ceramic core with a hub and drive shaft including a chain driven sprocket fixedly secured thereto and wherein damper means including first and second relatively movable parts are connected between the sprocket and hub and a resiliently yieldable slipper is located in the hub and compressible to accept hub loads without taking a permanent set; the damper means and slipper combining to damp oscillations in said matrix disc drive shaft during operation of the regenerator assembly and further operative to isolate frangible material of the core from shocks imposed thereon by the drive thereto.

2 Claims, 6 Drawing Figures

REGENERATOR DISC DRIVE

This invention relates to drive systems for gas turbine engines with regenerators having a rotatable matrix and more particularly to such regenerators having a rotatable ceramic core of frangible material.

In regenerator assemblies of the type having a rotatable disc type ceramic core with a regenerator seal assembly biased against the face of the ceramic core, torsional oscillations of an input shaft to the regenerator disc can be transmitted to the core from an associated drive assembly during operation of the gas turbine engine and can impose substantial loads thereon.

High temperature regenerators employed in gas turbines may include a rotatable ceramic core and seal structure cooperating therewith which have frangible properties but are high temperature resistant. Such regenerators must be driven through drive systems that isolate the torsional oscillation or vibration from the ceramic core.

Torsional vibration of regenerator matrix disc occurs when the disc is excited by the negative sloped friction characteristic of the regenerator seal material running on the surface of the ceramic core. This vibration takes place at the natural torsional frequency of the regenerator matrix disc and its drive train. In such systems, the regenerator disc is the mass and the drive train is the spring of a typical spring-mass system. In the case of a chain and sprocket drive shaft train, the springs of the system are the drive shafts and the chain, the chain predominating.

It should be realized that a typical regenerator of the type used with a gas turbine engine may have a regenerator matrix disc that is about two feet in overall diameter and about three inches thick in an axial direction. Such systems desirably must have excessive torque oscillations damped by means which easily can be connected in the matrix drive train. Furthermore, provision must be made to isolate the ceramic core from shocks due to sudden load changes or drive discontinuities and to define a load transfer footprint that prevents damage to the ceramic core at its hub.

One regenerator drive assembly with a damper unit included therein is disclosed in my U.S. Pat. No. 3,913,662, issued Oct. 21, 1975. Drive pads are disclosed in U.S. Pat. No. 3,476,173 issued Nov. 4, 1969, but they do not produce a returnable slight elastic deformation to isolate shock from a ceramic core.

An object of the present invention is to improve a drive assembly for use in ceramic core regenerator matrix drive units and for use in other applications wherein a friction or otherwise induced torsional vibration is established between input and output elements by the provision of a matrix drive shaft and spring damper unit connected in series with a hub assembly drive bar slipper pad of sponge metal which provides a slight elastic deformation to absorb drive shock to protect a ceramic core, the pad retaining its elasticity for prolonged high temperature operation to hold a shaft tightly in a hub and thereby prevent development of shaft play and resultant vibrations therefrom.

Still another object of the present invention is to provide an improved regenerator drive assembly for a rotatable ceramic core matrix disc having a central drive hub connected thereto with a drive shaft extending therefrom having a sprocket fixedly secured thereto driven by a roller chain element and a driven sprocket connected to one end of a torsion spring having its opposite end connected to the drive shaft and wherein the driven sprocket is further connected to one movable component of a viscous damper assembly which has a second movable component connected to the drive shaft and wherein the assembly is operative to damp out torsional oscillations between the input drive and the ceramic core matrix disc and wherein the damping effect of the viscous damper is further enhanced by a hub assembly shock absorber including a hub assembly drive bar slipper pad of sponge metal which provides a slight elastic deformation to absorb drive shock to protect a ceramic core, the pad retaining its elasticity for prolonged high temperature operation to hold a shaft tightly in a hub and thereby prevent development of shaft play and resultant vibrations therefrom.

Yet another object of the present invention is to improve a regenerator disc and drive coupling assembly for a regenerator disc core of frangible ceramic material with a central bore directed therethrough and a hub drive assembly including a hub element fixedly secured within said bore and an input drive for rotating said disc and further including seal means engageable with said disc by the provision of means for preventing damage to the core due to sudden load changes including first fluid coupling means connected between the input drive and the hub assembly to isolate frangible material of the ceramic core from vibrational shocks produced between the input drive and the hub assembly and further including a member located interiorly of the hub element and including radially outwardly directed arms thereon located at circumferentially spaced points around said hub element, each of the arms further including a bar element with a metallic sponge insert supportingly received on each of said bars and engageable with the walls of the hub element to provide an elastically yieldable thickness of metallic material compressed to at least one-half of its original thickness to accept imposed loads transferred from said fluid coupling means to the hub assembly and being maintained within its elastic range without permanent set so as to be resiliently returnable to its original thickness following acceptance of imposed load transfer from the fluid coupling means thereby to further isolate the frangible material of the ceramic disc from load imposed and/or shaft play shocks produced between the input drive and the hub element.

Further objects and advantages of the present invention will be apparent from the following description, reference being had to the accompanying drawings wherein a preferred embodiment of the present invention is clearly shown.

Figure 1:
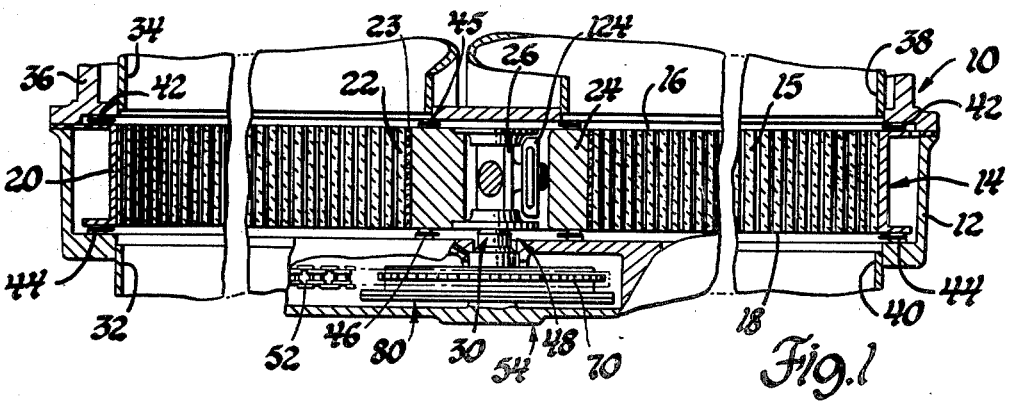
FIG. 1 is a schematic view of a rotary regenerator heat exchanger apparatus taken in a plane containing the axis of rotation of the matrix disc therein for purposes of illustrating the input drive thereto.
Figure 2:
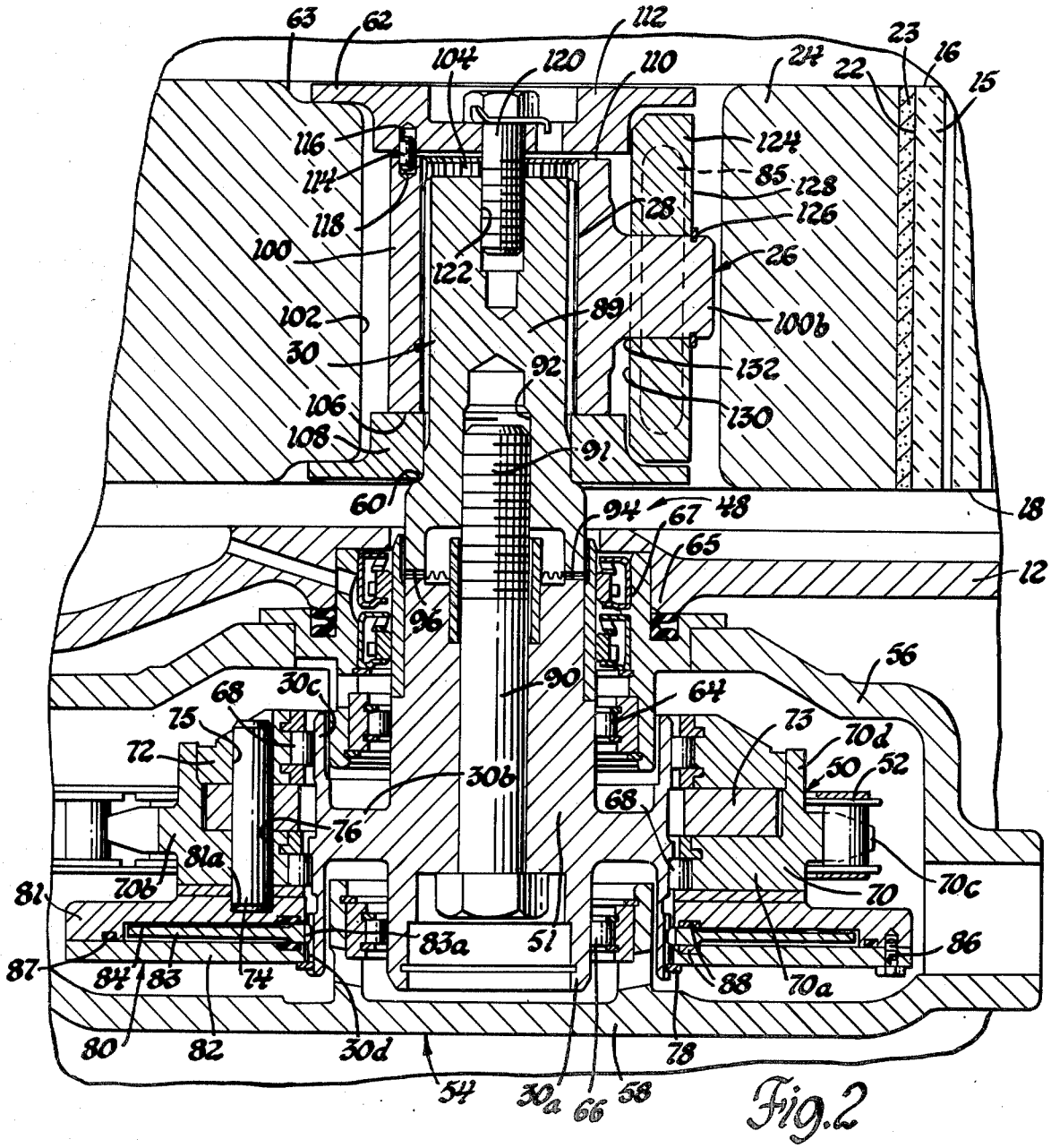
FIG. 2 is an enlarged, fragmentary sectional view of a regenerator assembly including the regenerator drive system of the present invention.
Figure 3:
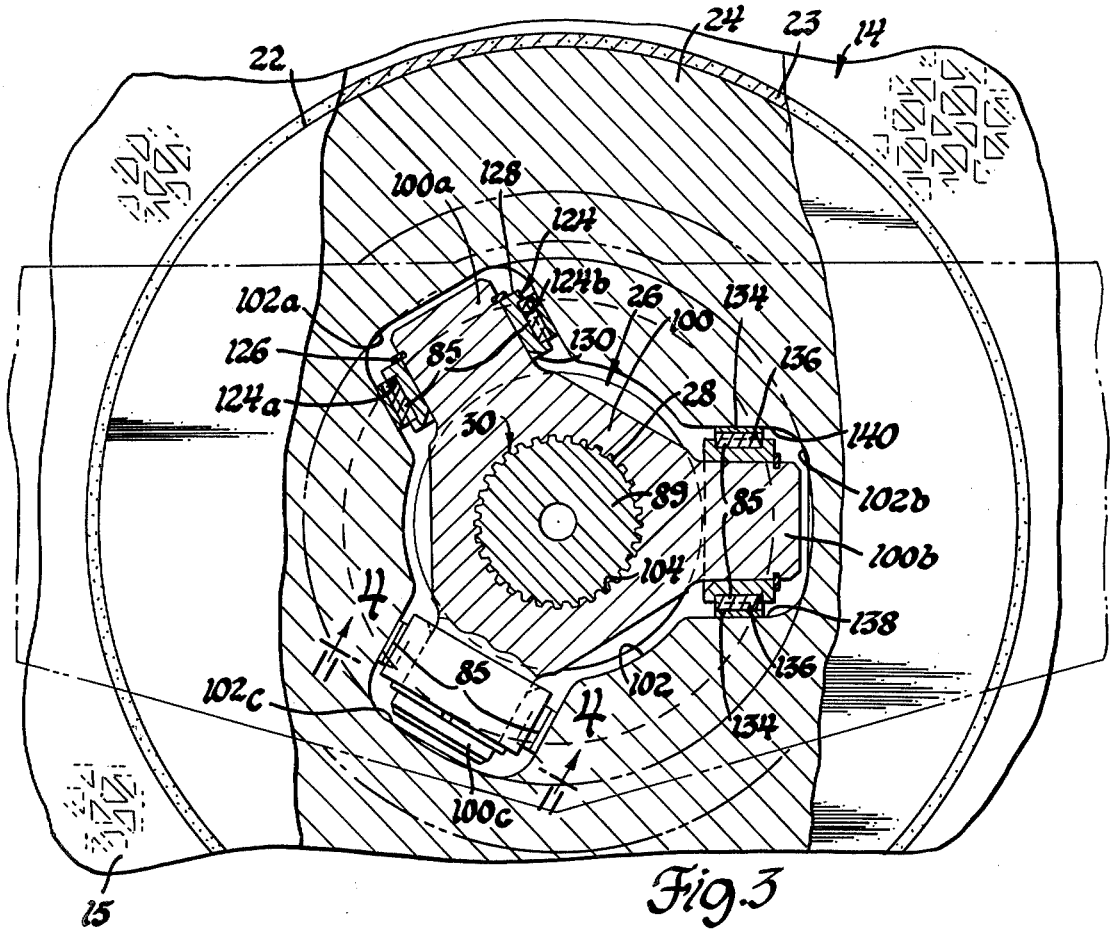
FIG. 3 is an end elevational view partially broken away and sectioned showing a hub assembly in the present invention.
Figure 4:
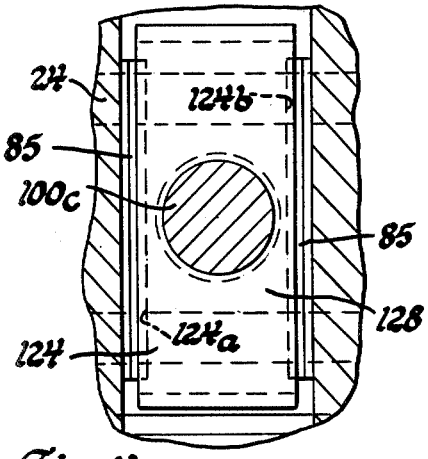
FIG. 4 is a cross sectional view taken along the line 4—4 of FIG. 3 looking in the direction of the arrows.

Referring first to FIGS. 1 and 2, a rotary regenerator heat exchanger apparatus 10 is illustrated of the type included in gas turbine engines having axial flow of inlet air thereto and axial exhaust of air therefrom. The apparatus includes a housing cover 12 generally drum shaped to enclose an annular, foraminous disc or matrix 14 including a ceramic core 15 of frangible material fabricated to define a large plurality of pores or passages extending from an inner face 16 of the matrix 14 to an outer face 18 thereof.

The matrix 14 further includes an outer rim 20 and an inner rim 22. The matrix is rotated about an axis defined by a locating and drive hub 24 connected to the matrix 14, for example by being secured to the inner rim 22 thereof by a layer of adhesive 23. The hub 24 includes a hub connector assembly 26 which connects to the outer diameter splines 28 of an input shaft 30.

An inlet 32 for high pressure inlet air enters one face of the housing 12 and, opposite to it, an outlet 34 is defined in an opposite cover 36 of the housing 12 for the discharge of compressed air which is heated as it is passed through the rotatable, disc configured matrix 14. Hot, low pressure exhaust gases enter the matrix 14 through an inlet 38 in cover 36 and leave the regenerator assembly 10 through an outlet 40 in cover 12. The two extremes of gas passing through the matrix 14 are in a counter-flow relationship in the embodiment of the illustrated regenerator heat exchanger apparatus 10.

As shown, the hot exhaust gas outlet 40 is of a larger area than the cool air inlet 32 because of the difference in densities of the cool versus the heated fluid passing through the matrix 14.

In the illustrated arrangement of the invention, seal assemblies 42, 44 including cross-arms 45, 46 are located at the inner and outer faces 16, 18 of the disc or matrix 14 to confine the cold and hot fluids to the desired flow path through the matrix 14 and to minimize leakage between the aforesaid paths.

Referring now to the subject matter of the present invention, the drive shaft 30 is connected to an improved drive assembly 48 by means of a sprocket drive assembly 50 in surrounding relationship to an outboard end 51 of the shaft 30. A driven roller chain 52 passes over the sprocket 50 and is encased within a chain guard and housing cover 54 including spaced portions 56, 58 as best shown in FIG. 2.

The hub connector assembly 26 is fixed axially with respect to the drive shaft 30 by engagement at one end against a shoulder 60 adjacent to the splined end of the shaft 30 and at its opposite end by a retaining flange 62 positioned in a suitable annular groove 63 provided for this purpose in hub 24. At its opposite end, the shaft 30 is rotatively supported by means of a pair of bearings 64, 66, one of which is positioned in a boss 65 of housing cover 12 and the other of which is positioned in the bored boss of cover 54. Seal assembly 67 prevents gas leakage exteriorly of the apparatus 10 along shaft 30.

The bearings 64, 66 are mounted at opposite ends of an enlarged portion 30*a* at the opposite or lower end 51 of the shaft 30, shown with reference to FIG. 2. The shaft 30, intermediate these bearings, is provided with a radially extending flange 30*b* shown formed integral therewith, which terminates in an axially extending annular flange 30*c*. This flange 30*c* is provided at one end, the lower end with respect to FIG. 2, with external splines 30*d*. The opposite end of the flange 30*c*, the upper end as seen in FIG. 2, is provided with an annular peripheral bearing surface to receive an annular bushing 68 with a generally annular surface therebetween extending substantially about the periphery of this intermediate portion but terminating in spaced apart radially extending shoulders to provide a spring lock seat for a purpose to be described hereinafter.

The sprocket drive assembly, generally designated 50 is journalled by the bearing 68 on the flange 30*c* of drive shaft 30 whereby this sprocket assembly is relatively rotatable with respect to the shaft 30. Sprocket assembly 50 includes a sprocket 70, a sprocket support 72 and a torsion spring 73. Sprocket 70 includes a bored, radial flange hub disc 70*a* integral with an axially extending annular flange 70*b* carrying the annular row of spaced apart sprocket teeth 70*c* adapted to be in driven engagement with chain 52 which in turn is driven through a drive sprocket, not shown, by a suitable power source, such as through a reduction gear unit operatively connected to the gas turbine engine with which the regenerator is used.

Sprocket support 72 abuts against shoulder portion 70*d* to hold support 72 in spaced relation from the radial flange 70*a* to provide an annular cavity therebetween in which the torsion spring 73 is positioned whereby this assembly of sprocket 70 and support 72 are rotatably journalled with respect to the shaft 30 by bearing 68. The sprocket support 72 and sprocket 70 are suitably fixed together, as by means of pins 74 press-fitted into suitable apertures 75, 76 provided for this purpose adjacent to the outer periphery of sprocket support 72 and the inner periphery of the flange 70*b* of sprocket 70. One end of the spring 73 is fixed for rotation with the sprocket 70 and the opposite end of the spring is fixed for rotation with shaft 30 with the spring itself providing flexible connection between these opposite ends of the spring. The spring 73 is mounted to the sprocket 70 and to the shaft 30 in such a manner so that as the sprocket 70 is rotated, it will tend to spirally wind the spring 73 about the shaft 30 to effect a drive coupling between the sprocket 70 and the shaft 30 in a manner whereby torsional oscillations between the sprocket and the shaft can be damped by a damper assembly to be described. The purpose of the spring 73 is to provide differential motion on which the damper can operate.

In addition, the sprocket assembly 50 is further associated with the shaft 30 by means of a damper assembly, generally designated 80, which encircles the splined end 30*d* of shaft 30 adjacent sprocket drive assembly 50 and which is connected in driven engagement with the sprocket 70 by means of the pin 74 of the sprocket assembly extending into a suitable drive socket provided for this purpose in one of the elements of the damper assembly.

Damper assembly 80 as best seen in FIG. 2, is positioned to encircle the splined end of shaft 30 and is fixed axially thereon by a retainer ring 78 positioned in a suitable annular groove in shaft 30 provided for this purpose adjacent one end of the splined portion 30*d* thereof. As shown, the damper assembly 80 includes a disc-like centrally apertured housing 81, a cover plate 82 in the form of an apertured disc and a damper disc 83. Housing 81 is provided on one side with an aperture or socket 81*a* therein to receive the pin 74, the other side of this housing being provided with an annular central recess 84 radially inward thereof. When this housing 81 is assembled to the cover plate 82 and fixed thereto as by circumferentially spaced apart machine screws 86, only one of which is shown, there is provided a damper housing assembly having an annular cavity therein bound on opposite sides by the internal axially spaced apart, radial extending walls of housing 81 and cover plate 82, adapted to rotatably receive the damper disc 83 therein. Disc 83 is centrally apertured and provided with internal splines 83*a* positioned in driving engagement with the axial extending splines 30*d* of shaft 30 while the damper housing assembly of housing 81 and cover plate 82 loosely encircles the shaft 30.

To effect sealing between the housing and cover plate and between these elements and the damper disc, an annular seal 87 is positioned in a suitable groove provided for this purpose in the housing radially outward of the recess 84 whereby this seal is sandwiched in sealing engagement between the housing 81 and the cover plate 82. Annular seals 88 are also positioned in suitable grooves provided for this purpose in the housing 81 and cover plate 82 for sealing engagement with opposite faces of the damper disc 83 radially outward from the internal splines 83*a*. The cavity provided by the annular recess 84 is filled with a suitable damper fluid of the desired viscosity, such as silicone oil, through one of preferably a pair of fill ports, not shown, in cover plate 82 whereby the cavity can be filled with damper fluid and air can be bled therefrom during the oil filling operation.

The thickness of damper disc 83 is such that a predetermined clearance exists on opposite sides of this disc relative to the damper housing 81 and to the cover plate 82, whereby this damper disc is not fixed for rotation with either of these elements but can have limited rotation relative thereto limited by the capacity of spring 73. However, with a suitable viscous damper fluid in the cavity flowing into these clearance spaces, there will be sufficient viscous drag or friction between the damper disc 83 and the housing 81, cover plate 82 assembly during operation whereby to damp out differential motion between the sprocket 70 and shaft 30 as allowed by spring 73. The seals 88 engaging opposite sides of the damper disc 83 should supply very limited drive torque, preferably none. With this arrangement, any differential motion existing between the matrix and drive shaft combination, and between the damper disc 83 and the housing 81 and cover plate 82 assembly, is damped by the viscous fluid in the clearance between the housing and cover plate relative to the disc 83. The clearance on opposite sides of the damper disc 83 is selected so that as the housing and cover plate assembly is rotated through its connection with the sprocket 70, there will be viscous shearing of the thin film of oil between the damper disc and the housing cover plate assembly to provide sufficient viscous drag on the damper disc 83 to effect a connection between these elements so that this viscous drag will damp out or limit torsional oscillation between the drive and driven elements of the regenerator assembly and to damp and eliminate disc vibration.

As previously described, relative to conventional regenerators, the regenerator disc in such a device is the mass and the conventional sprocket and drive shaft of the drive train thereof is the spring of a typical spring-mass system.

Figure 5:
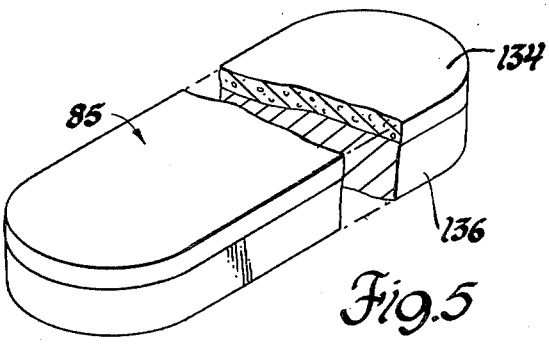
FIG. 5 is an enlarged, perspective view of a regenerator drive bar insert slipper of the present invention.

With reference to the embodiment shown, an additional spring, the spring 73, takes the drive torque between the sprocket 70 and the shaft 30 and is also flexed by any friction induced vibration. As described, the viscous damper assembly 80 is tied across this spring 73. The damper assembly 80 functions only when oscillatory conditions arise. Now, in accordance with the improved drive arrangement of the invention, another spring is inserted in series with the others in the drive train. This spring is in the form of hub assembly drive bar slippers 85, one of which is shown in FIG. 5.

In accordance with certain principles of the present invention, when vibration takes place in the matrix disc 14 and the drive train, torque oscillations as great as plus or minus 100% of steady state conditions can be experienced that can produce substantial stress of the ceramic core 15 at its hub connection. In the illustrated arrangement the disc or matrix 14 can be a mass in the order of 60 pounds and the drive train itself constitutes a spring of a typical spring-mass system.

The spring 73 is flexed by any friction induced vibration which is imposed thereon from the sprocket 70 as produced by negative slope friction characteristics as are produced between the regenerator seal assemblies 42, 44, cross-arm seals 45, 46 and the disc 14. The internal damper disc 83 of the damper assembly 80 will move to produce a positive damping torque on the spring 83 in response to torsional take-up in the spring 83 thereby to damp torsional oscillations between the sprocket 70 and matrix 14. However, in the case of ceramic cores additional consideration must be given to reduction of shock transmitted to the core 15 during the aforesaid damper action.

The drive shaft 30 further includes an inboard end 89 having the spline teeth 28 formed on the outside diameter thereof. The inboard end 89 is connected to the outboard end 51 by a connector bolt 90 having a threaded end 91 thereon threadably received in a tapped bore 92 on the outboard end of the shaft end portion 89. The bolt 90 threadably secures interlocking radially directed teeth 94, 96 formed on the facing ends of the shaft portions 51, 89 together to form the unitized drive shaft 30 that connects the previously described damper assembly 80 and spring 73 to the hub connector assembly 26 including the added spring component in the form of a bar slipper 85.

More particularly, the hub connector assembly 26 includes a spider carriage 100 having a plurality of radially outwardly directed arms 100*a*, 100*b*, 100*c* thereon located in spaced relationship to a central bore 102 in hub 24 with a plurality of radially outwardly directed hub slots 102*a*, 102*b* and 102*c* extending radially outwardly of the center of bore 102.

The spider carriage 100 has a plurality of internal spline teeth 104 thereon that slidably engage the external spline teeth 28 of the shaft 30 and the spider carriage 100 includes an outboard end 106 thereon in engagement with an end plate 108 that seats against the hub retaining shoulder 60 of the shaft 30.

The opposite end 110 of the carriage 100 is axially located by means of a second end plate 112 having the radial flange 62 thereon supportingly received in groove 63 of the hub 24. The end plate 112 is indexed by means of a dowel pin 114 connected between opposed bores 116, 118 in the end plate 112 and the opposite end 110 of the spider carriage 100. A threaded bolt 120 is directed through the end plate 112 into threaded engagement with a tapped hole 122 in the inboard end of the shaft portion 89 as best seen in FIG. 2. Accordingly, the space spider arms 100*a* through 100*c* are fixedly located in both axial and radial relationship to the hub bore 102.

Each of the arms carries a rectangularly configured tubular support bar 124 having side grooves 124*a*, 124*b* on opposite side faces thereof. Each of the support bars 124 is held in place on the spider arms 100*a* through 100c by means of a split retainer ring 126 which engages a radially outer face 128 of the bar. A radially inner face 130 of the bar 124 seats against a tapered annular shoulder 132 of each of the arms 100a as best shown in FIG. 2. Each of the grooves 124a, 124b receives one of the regenerator drive bar slippers 85 as shown in FIG. 5.

In accordance with the present invention each of these elements includes a metallic sponge layer 134 brazed to a solid back plate 136 that is seated in each of the slots 124a, 124b. The solid back plate 136 in the illustrated arrangement is a shim component and in some cases can be replaced by a solid mass of compressible metal material in the form of the layer 134. The layers 134 in each bar contact with side surfaces 138, 140 of each of the radial slots 102a through 102c and define an elastically yieldable thickness of metallic material compressed to one-half of its original thickness to accept imposed loads transferred from the damper assembly 80 and torsion spring 73 connected to the drive shaft 30 thence to the hub connector assembly 26. The compressible sponge metal of the layer 134 is selected to be maintained within its elastic range during load imposition without taking a permanent set. As such, the layer 134 is resiliently returnable to its original thickness following acceptance and transfer of imposed loads thereon from the shaft 30 to the hub 24.

The slippers 85 are further configured to define a large foot area to reduce unit loading between the spider carriage 100 and the hub 24. Each slipper 85 defines a spring component in series with the torsion spring 73 of the drive assembly and the combination of these elements has been found to be unusually suitable for reducing stress on the low strength ceramic material of the ceramic core 15 at its connection with the hub 24. Furthermore, the slippers 85 serve the further function of maintaining a tight resilient interconnection between the carriage 100 and the hub 24 to reduce shaft play at this point to hold the shaft 30 tightly in the hub 24 to thereby prevent shaft play with resultant excessive shock loadings.

Figure 6:
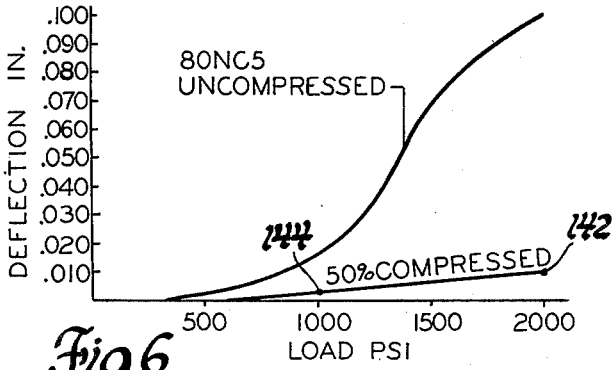
FIG. 6 is a chart showing the performance characteristics of the slipper in FIG. 5.

Referring now more particularly to FIG. 5, in the illustrated arrangement each of the pads are of an elongated rectangular configuration with semicircular end portions thereon. The sponge material layer 134 is formed of metallic Retimet 8ONC5, a trademark of Dunlop Ltd. The layer 134 is 50% compressed from pristine material prior to being connected to plate 136. In one working embodiment the original sponge thickness was 0.196 inches thick and was reduced to 0.98 inches and connected to a 0.42 inch plate 136. The back plate 136 is Armco 18SR, a trademarked material of Armco Steel Company. In the illustrated arrangement the Retimet layer 134 is connected to the plate 136 by filling the Retimet layer 134 with braze stop off. The layer 134 then is brazed to securely attach it to the underlying plate 136. Following the braze operation the stop-off material is ultrasonically removed. The resultant slipper 85 has sufficient resiliency to accept imposed loads without taking a permanent set. If desired, the plate 136 can be eliminated and replaced by a sponge layer 0.280 inches with original thickness compressed to 0.140 inches. The load versus deflection curve of FIG. 6 shows that the material does not permanently deform. On the illustrated curve a 2000 p.s.i. point indicated by reference numeral 142 is equal to a four hundred foot pound drive torque. The measured drive torque during testing of one working embodiment was about 150 foot pounds or generally below a 1000p.s.i. load point on the chart as shown by the reference numeral 144.

The insert slipper 85 defines a resilient, load transmitting member having a proper area or footprint to prevent damage to the ceramic core 15 of the assembly due to sudden load changes or drive discontinuities. The drive hub has a line fit to the ceramic core 15 so that the stack-up of tolerances is such that the ceramic core bore mean dimension and the hub drive mean dimensions are identical. Accordingly, the ceramic member can be cemented to the regenerator matrix.

It has been observed that in order to provide satisfactory protection of reduced strength ceramic cores in regenerator assemblies, the combination of the illustrated resiliently returnable slipper 85 and damped spring in a series configured relationship is necessary to produce satisfactory drive operation. The illustrated Retimet material retains its elasticity for long periods of time and at high temperatures in excess of 700° F. Accordingly, it will maintain close drive connection tolerances in the drive system to prevent shaft play vibrations from developing.

While the embodiments of the present invention, as herein disclosed, constitute a preferred form, it is to be understood that other forms might be adopted.

The embodiments of the invention in which an exclusive property or privilege is claimed are defined as follows:

1. In a regenerator disc and drive coupling assembly for preventing damage due to sudden load changes or drive discontinuities to a regenerator disc of frangible ceramic material with a central bore directed therethrough, a hub drive assembly including a hub element fixedly secured within said bore, an input drive for rotating said disc and seal means engageable with said disc, the improvement comprising: first fluid damper means connected between the input drive and said hub assembly to isolate the frangible material of the ceramic disc from load imposed shocks produced between the input drive and said hub assembly, a hub connector element operatively associated with said damper means, said connector element being located interiorly of said hub element and including radially outwardly directed segments thereon located at circumferentially spaced points around said hub element, means forming a coupling recess in surrounding relationship to each of said segments, and a metallic sponge pad supporting received on each of said segments and engageable with the walls of each of said coupling recesses to provide an elastically yieldable thickness of metallic material to accept imposed loads transferred from said fluid coupling means to the hub assembly and being maintained within its elastic range without permanent set during load imposition thereon so as to be resiliently returnable to its original thickness following acceptance of imposed load transfer from the fluid damper means thereby to further isolate the frangible material of the ceramic disc from load imposed shocks produced between the input drive and said hub, said sponge pad having a spring rate to maintain a resilient bias between said hub connector and said hub element to prevent drive play therebetween.

2. In a regenerator disc and drive coupling assembly for preventing damage due to sudden load changes or drive discontinuities to a regenerator disc of frangible ceramic material with a central bore directed therethrough, a hub drive assembly including a hub element fixedly secured within said bore, an input drive for rotating said disc and seal means engageable with said disc, the improvement comprising: first fluid damper means connected between the input drive and said hub assembly to isolate the frangible material of the ceramic disc from load imposed shocks produced between the input drive and said hub assembly, a spider element connected to said damper means and located interiorly of said hub element and including radially outwardly directed arms thereon located at circumferentially spaced points around said hub element, means forming a coupling recess in surrounding relationship to each of said arms, each of said arms further including a bar element supported thereon and located in spaced relationship to each of said recesses, and a metallic sponge pad compressed to at least one-half of its original thickness supportingly received on each of said bars and engageable with the walls of said coupling recesses to provide an elastically yieldable thickness of metallic material to accept imposed loads transferred from said fluid damper means to the hub element and being maintained within its elastic range without permanent set during load imposition thereon so as to be resiliently returnable to its original thickness following acceptance of imposed load transfer from the fluid damper means thereby to further isolate the frangible material of the ceramic disc from load imposed shocks produced between the input drive and said hub element, said sponge pad having a spring rate to maintain a resilient bias between said spider element and said hub element to prevent drive play therebetween.

* * * * *